US005964193A

United States Patent [19]

Dosdall

[11] Patent Number: 5,964,193

[45] Date of Patent: Oct. 12, 1999

[54] SYNCHRONOUS HYDRAULIC LASH ADJUSTER

[75] Inventor: James Michael Dosdall, Grosse Ile, Mich.

[73] Assignee: Ford Global Technologies, Inc., Dearborn, Mich.

[21] Appl. No.: 09/137,106

[22] Filed: Aug. 20, 1998

[51] Int. Cl.[6] ..... F01L 1/24

[52] U.S. Cl. ..... 123/90.43; 123/90.46; 123/90.55; 123/90.57

[58] Field of Search ..... 123/90.12, 90.15, 123/90.16, 90.39, 90.43, 90.46, 90.48, 90.49, 90.55, 90.57

[56] References Cited

U.S. PATENT DOCUMENTS

| | | | |
|---|---|---|---|
| 3,273,548 | 9/1966 | Hoffman . | |
| 3,587,539 | 6/1971 | Dadd . | |
| 3,799,129 | 3/1974 | Cornell . | |
| 3,805,753 | 4/1974 | Bergmann . | |
| 4,004,588 | 1/1977 | Scheibe . | |
| 4,098,240 | 7/1978 | Abell . | |
| 4,438,739 | 3/1984 | Arai . | |
| 4,462,364 | 7/1984 | Kodama . | |
| 4,481,913 | 11/1984 | Wirth . | |
| 4,509,467 | 4/1985 | Arai et al. | 123/90.16 |
| 4,522,169 | 6/1985 | Arai et al. | 123/198 F |
| 4,546,734 | 10/1985 | Kodama | 123/90.16 |
| 4,589,383 | 5/1986 | Showalter . | |
| 4,596,213 | 6/1986 | Hillebrand . | |
| 4,633,827 | 1/1987 | Buente . | |
| 4,807,576 | 2/1989 | Sonoda . | |
| 4,840,153 | 6/1989 | Aida . | |
| 5,161,500 | 11/1992 | Kubis et al. | 123/321 |
| 5,163,389 | 11/1992 | Fujikawa et al. | 123/90.16 |
| 5,233,951 | 8/1993 | Hausknecht | 123/90.12 |
| 5,398,648 | 3/1995 | Spath . | |
| 5,622,147 | 4/1997 | Edelmayer . | |
| 5,660,153 | 8/1997 | Hampton . | |
| 5,862,784 | 1/1999 | Blowers | 123/90.36 |

*Primary Examiner*—Weilun Lo
*Attorney, Agent, or Firm*—Roger May; Jerome Drouillard

[57] ABSTRACT

A system for minimizing lash in the valve components of an internal combustion engine including a lash adjuster assembly with a body having a closed bore formed therein. A piston is slidingly received within the bore. A cam is in communication with one surface of the assembly for imparting motion thereto. The assembly also has a fluid reservoir and chamber formed therewithin. The chamber is formed between the bore bottom surface and the bottom surface of the piston. A valve opening is also formed in the assembly for providing fluid communication between the reservoir and the chamber. A check valve mechanism is in communication with the valve opening for selectively opening and closing the valve opening in response to angular position of the cam.

5 Claims, 2 Drawing Sheets

SYNCHRONOUS HYDRAULIC LASH ADJUSTER

TECHNICAL FIELD

The present invention relates generally to hydraulic lash adjusters. More specifically, the present invention relates to a hydraulic lash adjuster for an internal combustion engine which synchronizes lash adjustment with angular position of the cam.

BACKGROUND

The intake and exhaust valves of an internal combustion engine are typically closed by springs and opened by cams operating on the valve stems by the application of force through some sequence of linkages which may include cam followers, rocker arms, and pushrods. Ideally, the sum of the lengths of all the components that open and close the valves should allow the system to operate at zero lash at all times, despite manufacturing variations and changing conditions of wear and thermal expansion. Zero lash with interference can prevent the valves from seating, disrupt engine operation, and subject the valve train to excessive forces, excessive wear, and deposits from incomplete combustion. Lash can cause noisy engine operation as well and component failure from fatigue.

Hydraulic lash adjusters have been in use for years to provide a mechanism for dynamically altering the length of a component in the valve train during operation to eliminate lash. The configuration of these lash adjusters includes a piston fitted in a bore for trapping a volume of fluid. The lash adjuster admits some of the volume of fluid through a check valve when a small spring is able to push the piston upwardly to take up any lash. Additionally, these lash adjusters provide for a leak path to leak fluid while the adjuster is under pressure either from interference or from normal cam lift. The designed leak rate, set by expensively precise machining of the piston-to-bore clearance, is also affected by wear, thermal expansion, and oil viscosity which varies widely with operating temperature, oil grade, contamination, dilution, or aeration.

These prior lash adjuster designs which depends on leak rate to eliminate lash contain an inherent conflict between lash adjustment rate capability with tightest clearances and cold viscous oil on the one hand, and loss of valve lift from excessive leakdown with thin oil and loose clearances on the other hand. Engine operating strategies for rapid catalyst light off on startup demand the most rapid compensation for exhaust valve expansion when the oil is cold and least able to accommodate expansion. Thus, the capabilities of the conventional lash adjuster designs are unable to adequately compensate for valve expansion which occurs during engine startup with certain engine operating strategies.

SUMMARY OF THE INVENTION

The present invention is directed to overcoming one or more of the problems as set forth above. It is an object of the present invention to provide a lash adjuster mechanism that eliminates need for a leak path, thus eliminating the performance compromises present with current lash adjusters as well as the need for the costly precision machining of the piston and bore.

According to the present invention, the foregoing and other objects are attained by providing a system for minimizing lash in the valve components of an internal combustion engine. The system includes a lash adjuster assembly having a body with a closed bore formed therein. The bore slidingly receives a piston, having a top surface and a bottom surface, therewithin which contacts the bore periphery and is sealed against fluid communication through that contact with the piston. A cam is in communication with one surface of the assembly for imparting motion thereto. The assembly also has a fluid reservoir and a fluid chamber formed therewithin. The fluid chamber is formed between the bore bottom surface and the bottom surface of the piston. A valve opening is also formed in the assembly for providing fluid communication between the reservoir and the chamber. A valve mechanism is in communication with the valve opening for selectively opening and closing the valve opening in response to angular position of the cam.

Additional objects and features of the present invention will become apparent upon review of the drawings and accompanying detailed description of the preferred embodiments.

DESCRIPTION OF THE PREFERRED EMBODIMENT

The ideal valve adjuster is infinitely and indefinitely stiff during cam lift, but fully compliant to zero lash whenever the cam is riding on base circle. This implies that the correct lash adjuster control principle is cam angular position, rather than valve linear position, linkage force, or fluid pressure.

In the disclosed invention, a secondary cam or linkage opens a valve in the lash adjuster during all or part of the base circle period to accept or release as much fluid as necessary to establish cam contact as the lash adjuster piston is lightly pushed by a spring, supply oil pressure, or some other means. At all times of cam lift, engine fluid, such as oil or the like, is trapped inside the sealed chamber of the lash adjuster and does not leak down even if the engine comes to rest with a valve lifted by a cam lobe.

Figure 1:
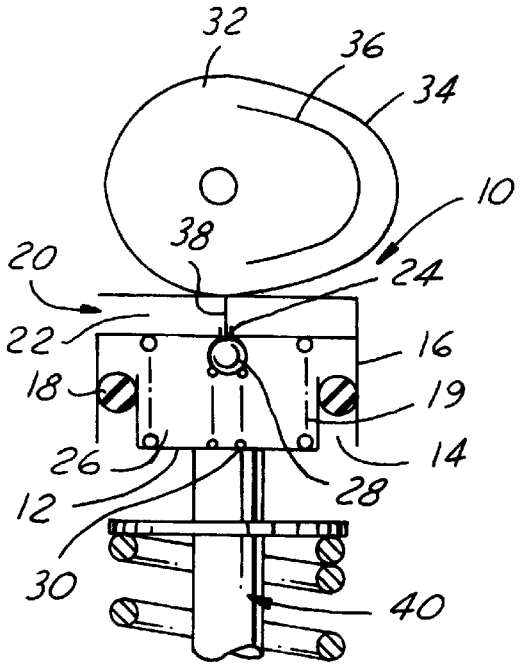
FIG. 1 is a schematic cross-sectional illustration of a lash adjuster for a valve configuration in which the cam acts directly on the valve stem in accordance with a preferred embodiment of the present invention.

One preferred configuration is a lash adjuster having a direct acting bucket tappet, as shown in FIG. 1. The bucket tappet lash adjuster 10 has a piston 12 fitted in a bore 14 of a body member 16. A resilient seal 18 is located in the bore between the outer surface of the piston 12 and the inner surface of the body member 16. A spring 19 is also included which provides a light spring force biasing the piston 12 and the body member 16 apart. Engine fluid enters the lash adjuster 10 from a fluid supply 20 and fills a fluid reservoir 22. The fluid from the fluid reservoir 22 flows through a valve opening 24 and into an enclosed fluid chamber 26. The fluid reservoir 22 is preferably located in the body member 16, however, it should be understood that the fluid reservoir 22 can also be located in the piston 12. The valve opening 24 is selectively opened and closed by ball or pintle valve 28. The ball valve 28 is biased into a closed position by a spring member 30.

A cam 32 is preferably in communication with the top surface of the piston 12. However, the cam 32 could also be in communication with the body member 16. The cam 32 has a primary lobe portion 34 and a secondary lobe 36. The secondary lobe 36 on the cam is in communication with a push rod 38 such that when the secondary lobe contacts the push rod 38, it moves the push rod 38 down, while the primary cam is on its base circle. As the push rod 38 is in communication with the valve 28, the valve 28 is moved away from the valve opening 24, against the force of the spring member 30 to allow fluid to flow from the fluid reservoir 22 in or out of the fluid chamber 26. This exchange of engine fluid is sufficient to re-establish zero lash. When the push rod 28 loses contact with the secondary lobe 36 such as before the primary cam begins to lift the engine valve 40, the valve 28 will engage the valve opening 24 and prevent the flow of fluid through the valve opening 24.

Figure 2:
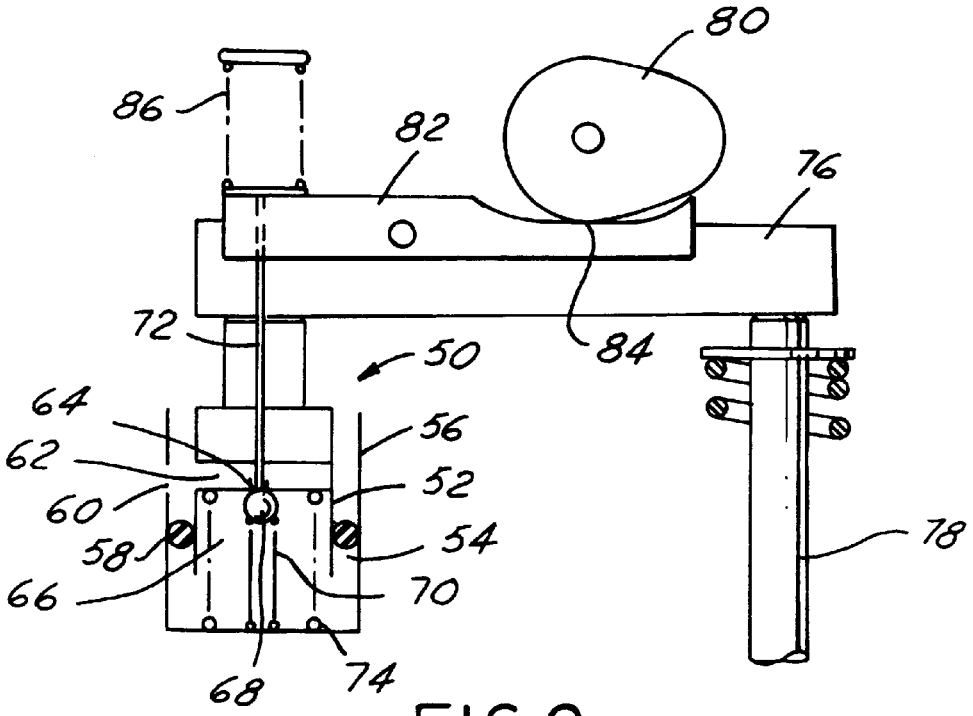
FIG. 2 is a schematic cross-sectional illustration of a lash adjuster having a secondary cam follower for a valve configuration which interposes a cam follower or rocker arm between the cam and the valve stem in accordance with another preferred embodiment of the present invention.
Figure 3:
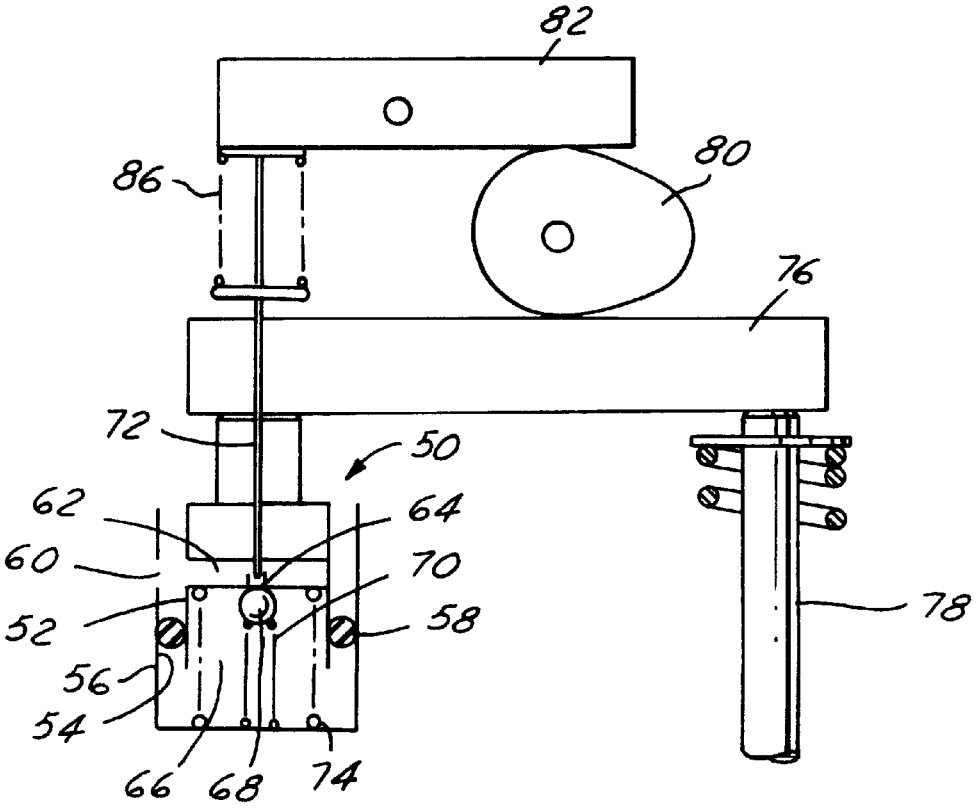
FIG. 3 is a schematic cross-sectional illustration of a lash adjuster having an alternate secondary cam follower for a valve configuration which interposes a cam follower or rocker arm between the cam and the valve stem in accordance with another preferred embodiment of the present invention.

FIGS. 2 and 3 illustrate alternative embodiments of the present invention for lash adjuster configurations that use a rocker arm or cam follower. FIGS. 2 and 3 both illustrate a lash adjuster 50 having a piston 52, fitted in a bore 54 of a body member 56. The bore 54 is sealed by a resilient seal 58 preventing fluid flow between the piston 52 and the body member 56. Engine fluid enters the lash adjuster 50 through an inlet opening 60 and fills a fluid reservoir 62. The fluid from the fluid reservoir 62 flows through a valve opening 64 and into an enclosed fluid chamber 66. The fluid reservoir 62 is located between the piston 52 and body member 56, however, it should be understood that the fluid reservoir 62 can also be located in the body member 56.

The valve opening 64 is selectively opened and closed by ball or pintle valve 68. The valve 68 is pushed into a closed position by a spring member 70, or alternatively in the case of a pintle valve, pulled closed by spring member 86. The valve member 68 is preferably in communication with a push rod 72 for opening and closing the valve opening 64. A second spring member 74 is preferably located beneath piston 52 to bias it upwards. The lash adjusters 50 in FIGS. 2 and 3 are in communication with a primary cam follower 76 which actuates the engine valve 78 through rotation of a cam 80. As the cam 80 rotates through one entire revolution, the engine valve 78 goes through an entire cycle.

A secondary cam follower 82 is preferably included for actuation of valve 68 through movement of the push rod 72. It should be understood that other indirect valve linkages may be utilized. In the embodiment shown in FIG. 2, the secondary cam follower 82 has a cupped portion 84 which is shaped to contact the cam lobe for a longer duration than the primary cam follower 76 which moves the engine valve 78. The secondary cam follower has a spring member 86 biasing the push rod 82 downward and thus moving the valve 68 away from the valve opening 64. When the cam lobe 80 is contacting the secondary cam follower 82, the push rod 72 is lifted upward against the spring member 86 which allows the spring 70 to move the valve 68 back into communication the valve opening 64 closing the fluid chamber 66 and trapping a volume of fluid therein. After the lobe passes, the secondary cam follower 82 releases the spring member 86 to push the valve 68 back open.

In an alternative embodiment shown in FIG. 3, the secondary cam follower 82 is positioned above the cam 80. The spring member 86 is positioned below the secondary cam follower 82 and above the primary cam follower 76. In operation, the back side of the cam 80 pushes the spring member 86 which is in direct communication with the push rod 72 downward to move the valve 68 away from the valve opening 64 against the force of the spring 70. The valve 68 is pushed open during a portion of the primary follower's base circle period and is closed otherwise. In the embodiments shown in both FIGS. 2 and 3, at all times of cam lift, engine fluid is trapped inside the fluid chamber 66 and does not leak down even if the engine is stopped on a lobe.

Figure 4:
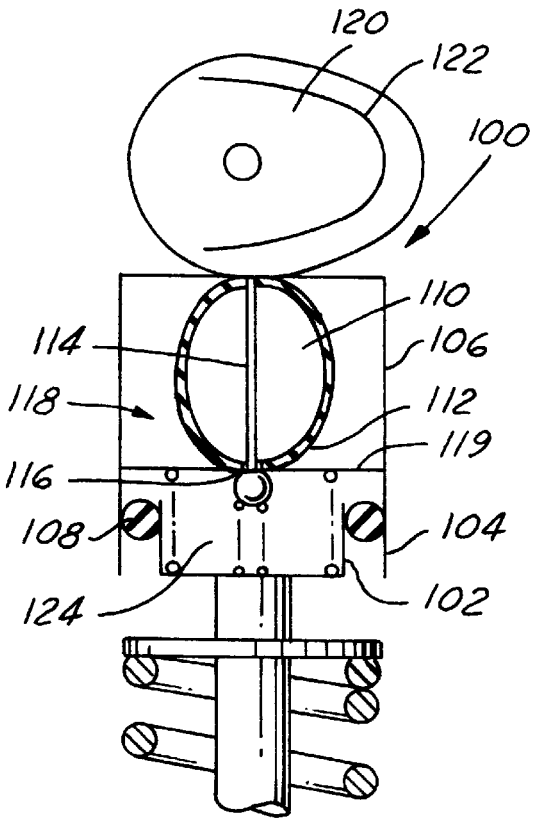
FIG. 4 is a schematic cross-sectional illustration of an alternate lash adjuster having a sealed working fluid in accordance with another preferred embodiment of the present invention.

FIG. 4 illustrates another embodiment of a lash adjuster in accordance with the present invention. The lash adjuster 100 has a body member 104 with a bore 106. The lash adjuster body 100 has working fluid stored therein in a reservoir 110. The working fluid is kept in an encapsulated sealed chamber 118. The utilization of sealed working fluid eliminates any uncertainties in viscosity, contamination, and aeration presented by engine fluid. In the embodiment shown in FIG. 4, the reservoir 110 of working fluid is preferably housed within a flexible bladder 112 that is located in the chamber 118 within the lash adjuster body 100. The flexible bladder 112 equalizes the working fluid's pressure to atmosphere.

A push rod 114 is positioned within the reservoir 110 and exits through an opening 116 formed in the bladder 112. A cam 120 is in direct communication with the lash adjuster body 100. Any of the linkages illustrated in FIGS. 1, 2, or 3 may be used to activate the push rod 114, moving it downward and allowing fluid to exit the flexible bladder 112 and thus the reservoir 110. By enclosing the working fluid reservoir 110 in a bladder 112, operation in any position is permitted.

Alternatively, the flexible bladder 112 may be eliminated. In this embodiment, the sealed working fluid would rest in the chamber 118 on the bottom surface 119. The chamber 118 would thus have an amount of working fluid pooled on the bottom surface 119 with air above the working fluid. The working fluid would pass through the valve opening 116 through the force of gravity.

In another alternative embodiment, pressurized gas is included around the flexible bladder 112. The gas pressure in the body chamber 118 outside the bladder replaces the piston extending spring and the valve closing spring from previous embodiments. In this embodiment, another seal would need to be included at the point where the push rod 114 enters the sealed chamber 118 to prevent the gas from escaping.

The present invention may be embodied in other specific forms without departing from the spirit or essential attributes thereof; therefore, the illustrated embodiments should be considered in all respects as illustrative and not restrictive, reference being made to the appended claims rather than to the foregoing description to indicate the scope of the invention.

What is claimed is:

1. A lash adjuster for minimizing lash in an internal combustion engine having an engine valve actuated by rotation of a cam, comprising:

a body having a closed bore formed therein;

a piston slidingly received within and contacting said bore periphery and sealed against fluid communication through said contact, said piston having a top surface and a bottom surface, a fluid reservoir formed within said lash adjuster;

a chamber formed between a bottom surface of said bore and said bottom surface of said piston;

a valve opening formed in said assembly providing fluid communication between said reservoir and said chamber; and a valve in communication with said valve opening to open and close said valve opening;

whereby said valve opens and closes said valve opening in response to a movement of a secondary cam follower which is separate from a primary cam follower which opens and closes said engine valve, and both said primary and secondary cam followers are actuated by said cam.

2. The lash adjuster of claim 1, wherein said valve is in indirect communication with said cam through an intermediate linkage, whereby said valve is pushed away from said valve opening by said intermediate linkage.

3. The lash adjuster of claim 2, wherein said intermediate linkage, includes a push rod which opens said valve opening.

4. The lash adjuster of claim 3, wherein an incompressible liquid working fluid is supplied to said reservoir.

5. The lash adjuster of claim 4, wherein said piston is extended from said bore by a spring member.

* * * * *